US005489926A

United States Patent [19]

Arbeiter

[11] Patent Number: 5,489,926

[45] Date of Patent: Feb. 6, 1996

[54] ADAPTIVE CONTROL OF SECOND PAGE PRINTING TO REDUCE SMEAR IN AN INKJET PRINTER

[75] Inventor: Jason R. Arbeiter, Poway, Calif.

[73] Assignee: Hewlett-Packard Company, Palo Alto, Calif.

[21] Appl. No.: 56,338

[22] Filed: Apr. 30, 1993

[51] Int. Cl.[6] ..... B41J 2/01; B41J 11/42

[52] U.S. Cl. ..... 347/16; 347/102; 101/488

[58] Field of Search ..... 346/1.1, 25, 134, 346/140 R; 101/424.1, 487, 488; 395/111, 113; 347/102, 16; 400/583.4; B41J 2/01, 2/17, 29/00

[56] References Cited

U.S. PATENT DOCUMENTS

| | | | |
|---|---|---|---|
| 4,469,026 | 9/1984 | Irwin | 346/25 X |
| 4,566,014 | 1/1986 | Paranjpe et al. | 346/1.1 |
| 5,214,442 | 5/1993 | Roller | 346/1.1 |

FOREIGN PATENT DOCUMENTS

| | | | |
|---|---|---|---|
| 423820 | 4/1991 | European Pat. Off. | B41J 2/17 |
| 57-69077 | 4/1982 | Japan | 400/583.4 |
| 1-113249 | 5/1989 | Japan . | |
| 2-78586 | 3/1990 | Japan . | |
| 3-133646 | 6/1991 | Japan . | |
| 3-173647 | 7/1991 | Japan . | |
| 4-39048 | 2/1992 | Japan . | |
| 4-255354 | 9/1992 | Japan | B41J 2/01 |

*Primary Examiner*—Benjamin R. Fuller
*Assistant Examiner*—Alrick Bobb

[57] ABSTRACT

A high density graphics image can be printed without smearing by contact with a second page, without any unnecessary reduction of throughput. Throughput enhancement logic is inhibited during the printing of the second page for a variable delay related to the image density of the first page. The variable delay is calculated as a linear function of both the density (relative to a predetermined grid size) and the location if the densest portion of the first page, using coefficients which are different for different print modes. In one preferred embodiment, a maximum density is calculated by counting drops of ink in each of several overlapping grids, and the magnitude and location of the maximum density grid on a prior page is used to limit the throughput of a next page until a sufficient delay has elapsed to ensure that ink on the prior page will not be smeared when it comes into contact with the next page.

26 Claims, 12 Drawing Sheets

ADAPTIVE CONTROL OF SECOND PAGE PRINTING TO REDUCE SMEAR IN AN INKJET PRINTER

TECHNICAL FIELD OF THE INVENTION

The present invention relates in general to inkjet printers and in particular to printing high quality images having densely inked areas without smearing the print media.

CROSS-REFERENCE TO RELATED APPLICATIONS

The following commonly assigned U.S. patent application filed concurrently herewith claims an invention which, although believed to be patentably distinguishable, has objectives and which is based on principles that are closely related to those of the present invention:

J.R. Arbeiter et al, "Densitometer for Adaptive Control of Ink Drying Time for Inkier Printer" Ser. No. 08/056, 330 filed Apr. 30, 1993.

BACKGROUND OF THE INVENTION

Inkjet printers operate by sweeping a pen with one or more inkjet nozzles above a print medium and applying a precision quantity of liquid ink from specified nozzles as they pass over specified pixel locations on the print medium.

The print medium becomes damper and remains damp for a longer time as more ink is applied on the same area of the print medium. As a first approximation, the drying time, before which the ink is not subject to smearing by contact with an adjacent sheet is a linear function of amount of ink applied. In certain prior art inkjet printers, a fixed delay is introduced between any physical contact between successively printed sheets, which is greater than the maximum time required to dry the densest possible image to the point that it is not susceptible to smearing. However, this unnecessarily restricts throughput when the printed images on some pages do not contain any densely inked portions and/or when large unprinted areas appear on succeeding pages which can be completely bypassed by the print head.

Thus, the prior art has failed to provide a satisfactory solution for printing a high quality graphics image at a high throughput rate, which is further exacerbated if additional dots of ink are selectively applied between adjacent pixels, thereby effectively doubling the number of dots of ink, in order to increase image density and/or to provide smoother boundaries for any curved or diagonal images ("Resolution Enhancement Technology").

SUMMARY OF THE INVENTION

Therefore, an overall objective of the present invention is to provide an improved inkjet printer whereby a page of high density graphics images can be printed without smearing by contact with a second page, without any unnecessary reduction of throughput.

In accordance with one aspect of the present invention, throughput enhancement logic is inhibited during the printing of the second page for a variable delay related to the image density of the first page. In accordance with specific aspects of the invention, the variable delay is calculated as a linear function of both the density (relative to a predetermined grid size) and the location if the densest portion of the first page, using coefficients which are different for different print modes.

DESCRIPTION OF THE PREFERRED EMBODIMENT

Figure 1:
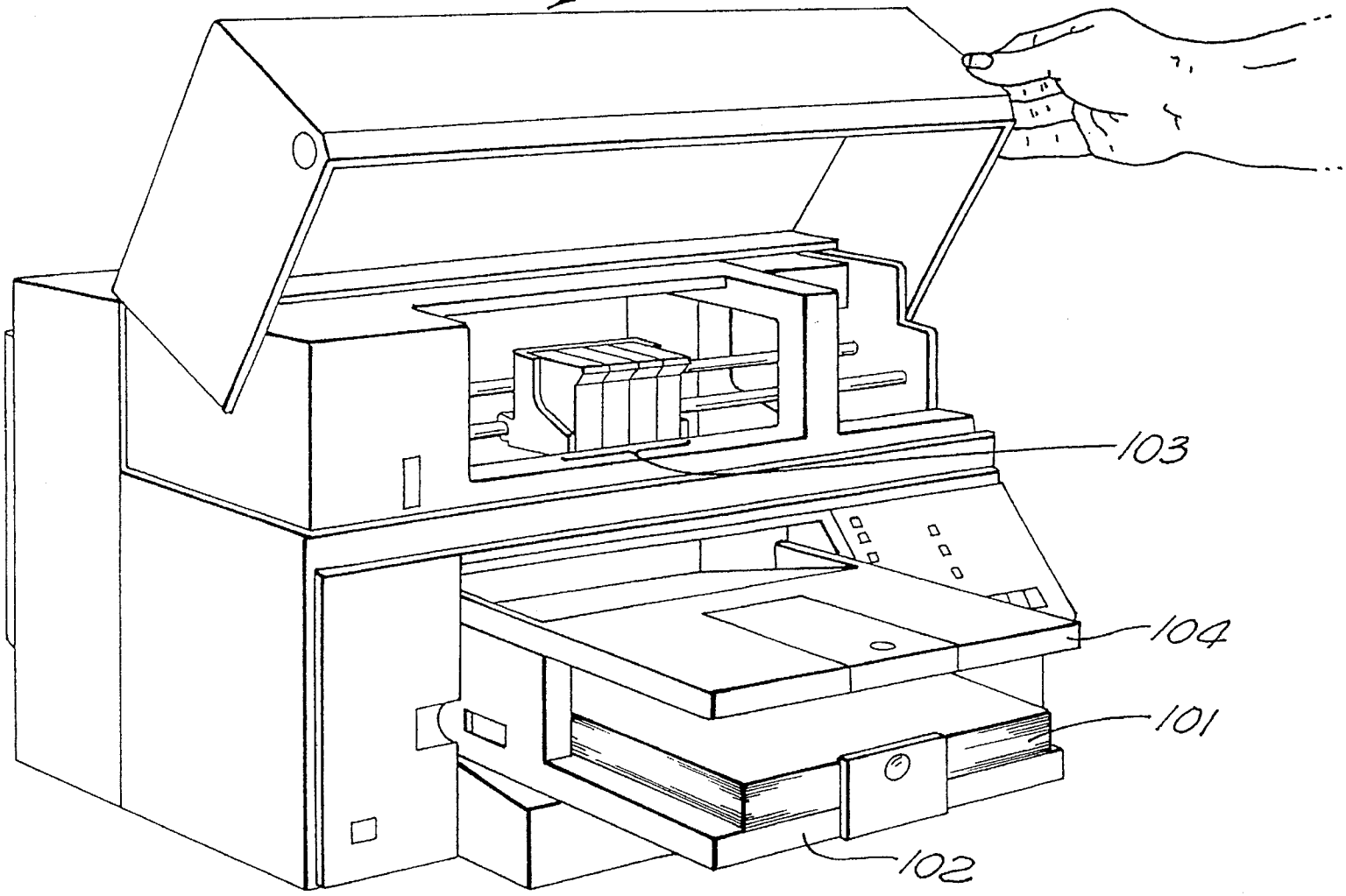
FIG. 1 is diagram of an inkjet printer embodying the present invention and having a plurality of inkier nozzles, an input tray and an output tray.

FIG. 1 is a diagram of an inkjet printer 100 wherein the present invention is embodied. The printer 100 performs printing on sheets of paper 101 or other print media which are supplied from an input tray 102. The print media are printed by a plurality of inkjet nozzles 103 in the printer 100. After a print medium is printed, it is output and stacked onto an output tray 104.

Figure 2:
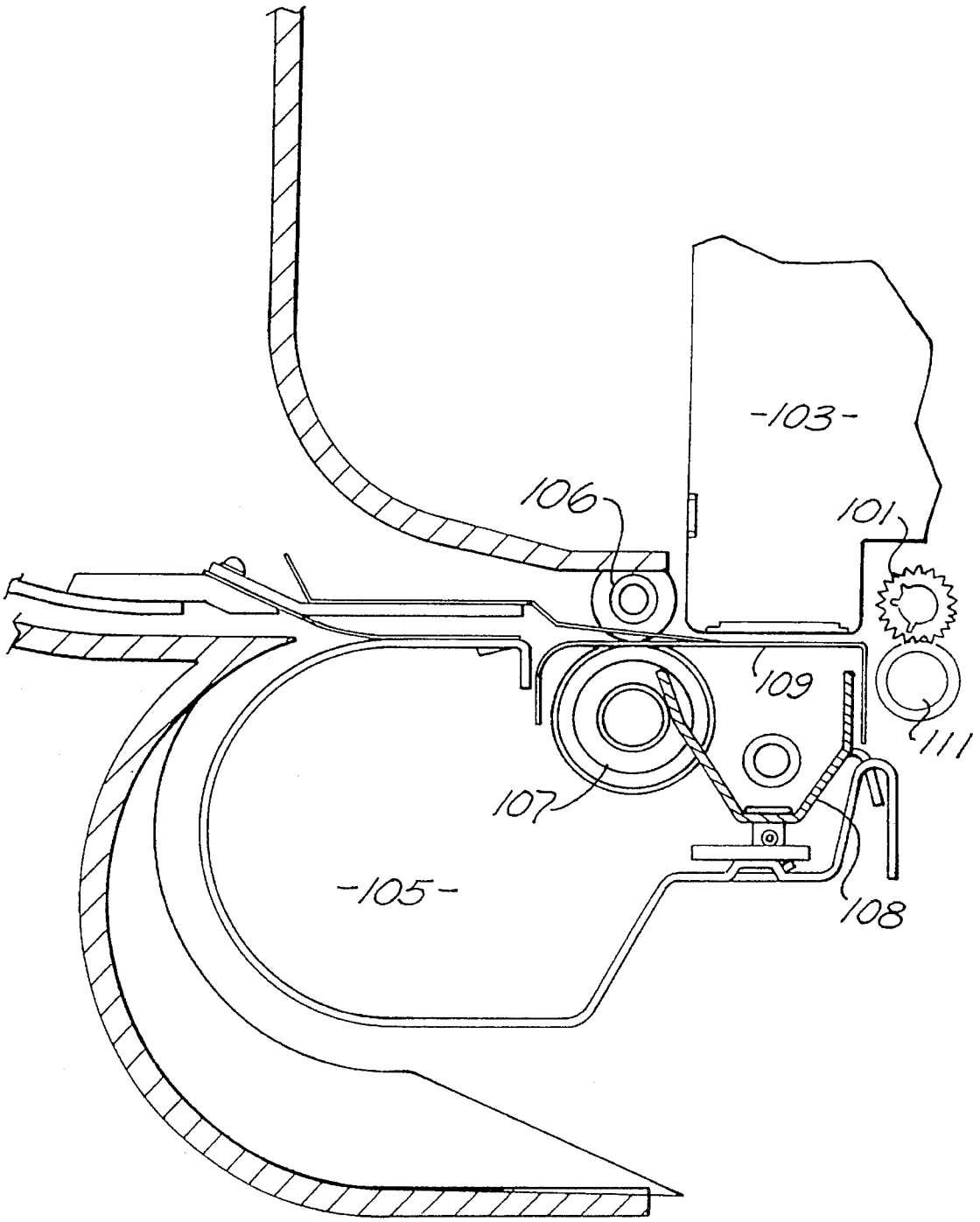
FIG. 2 is a diagram of the paper path within the inkjet printer of FIG. 1.

FIG. 2 is a side view which shows the path along which a sheet of paper travels within the printer 100. When a sheet of paper is picked from tray 102, it is pushed by a feeder mechanism (not shown) into a paper path at the lower part of a forward paper guide 105. Before the paper passes inside the paper path defined by guide 105, it is preheated by heat generated from a preheater (not shown).

The paper path directs the paper to an interface between a pinch wheel 106 and a main drive roller 107 which is rotated by a motor (not shown). The main drive roller 107 and the pinch wheel 106 operate together to advance the paper over a platen 109 which is heated by a heater 108. A swath of ink (typically 96 nozzles high, or about 8 mm) is applied to the paper lying over the heated platen and the heater 108 accelerates the evaporation of solvent absorbed by the paper.

The inkjet nozzles 103 are carried by a carriage which is driven along the support shaft by a mechanism which comprises, for example, a motor and a belt. Each trip along the support shaft is conventionally called a sweep.

The inkjet nozzles 103, when activated, apply droplets of ink onto the paper. Typically, the inkier nozzles are mounted on the carriage in a direction perpendicular to the direction of the sweep, so that columns of dots are printed in one sweep. The columns of dots made by inkjet nozzles across a horizontal portion of the paper is sometimes called a swath. A swath may be printed by one or more passes of the inkier nozzles across the same horizontal portion, depending upon the required print mode. In order to reduce undesirable "banding", some of the known printing modes advance the print medium relative to the carriage in the vertical direction by only a fraction of the height of a single swath; in order to reduce "bleeding", multipass printing modes may be used in which the dots applied in successive passes are interleaved vertically and horizontally. Moreover, both single pass and multiple pass print modes may employ "Resolution Enhancement Technology" in which additional dots of ink are selectively applied between adjacent pixels to increase image density and/or to provide smoother boundaries for curved or diagonal images.

When a swath is completely printed, the paper is advanced and ejected into the output tray 104, with the assistance of starwheel 110 and an output roller 111 which cooperate to produce a pulling force on the paper. A starwheel is used so that its pointed edges can pull the paper at the printed surface without smearing.

Figure 3:
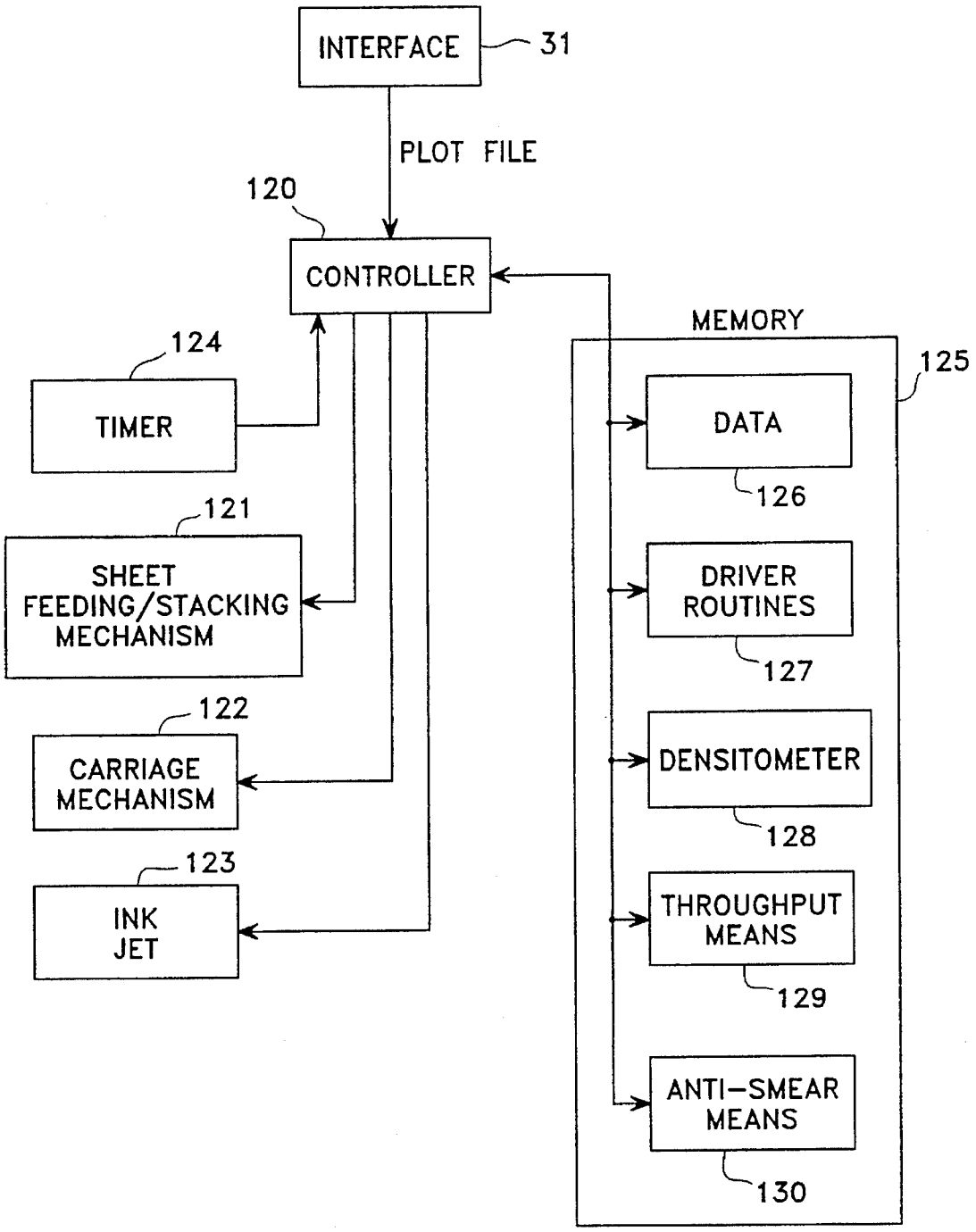
FIG. 3 is a block diagram of the main hardware components of an inkjet printer and the related software.

FIG. 3 is a logic diagram showing the main hardware components of the printer 100 and the related software. The hardware components include a controller 120 which operates to control the main operations of the printer 100. For example, the controller controls the sheet feeding/stacking mechanism 121, including the pinch wheel 106, the main drive roller 107, the starwheel 110 and the output roller 111, to feed and position a sheet of paper during a printing process. The controller 120 also controls the carriage drive mechanism 122 to move the carriage across the paper, The controller 120 also controls the inkjet nozzles 123 to activate them at appropriate times so that ink can be applied at the proper pixels of the paper.

The controller 120 performs the control functions by executing instructions and data accessed from a memory 125. For example, data to be printed are received by the controller 120 under the control of a software driver. The data received are stored in a "plot file" within a data area 126 in the memory 125.

The instructions can be classified logically into different procedures. These procedures include different driver routines 127 such as a routine for controlling the motor which drives the main drive roller, a routine for controlling the motor which drives the output roller/star wheel, a routine for controlling the motor which drives the carriage and a routine for controlling activation of the inkjet nozzles.

One or more timers 1 are available to controller 120. A timer may be simply a starting clock value stored at a predetermined location in the memory. To obtain an elapsed time value, the stored starting value is then subtracted from an instantaneous clock value from a realtime clock (not shown).

The memory 125 also stores a throughput procedure 129. The throughput procedure operates to control the throughput of the printer 100. Throughput may be thought of as the sum of a first duration T1 and a second duration T2, where T1 is the time duration between the time immediately before a first swath is printed on a sheet of paper and the time immediately after the last swath is printed, and T2 is the time duration between the final position of one sheet and the initial position of the next sheet. T2 represents the sheet feeding delay of the printer, which is typically constrained only by the drive mechanism and is therefor a constant; however T1 is also constrained by various factors related to the complexity and density of the image and the desired print quality, which in turn determine how much time is required for each of the sequential process steps of the selected print mode. Throughput procedure 129 uses horizontal and vertical logic seeking to identify blank lines between adjacent swaths (vertical logic seeking) and blank portions at either end of (or possibly within) a swath, altogether avoiding any unnecessary carriage movements and slewing the carriage at maximum slew rate over any unprinted areas over which the carriage must be slewed.

The memory 125 also stores a densitometer procedure 128 which determines a maximum density of dots of ink to be printed in the current swath, and a second page anti-smear procedure 130 which operates in response to the results from the densitometer procedure 128 to ensure that the ink of a preceding sheet of paper is not smeared when the current sheet of paper is output.

Typically, a sheet of paper is printed by applying ink at the specified dot positions (pixels). The dots may be printed in single (e.g., black) or multiple colors. To print a multiple color image, the carriage may have to make more than one sweep across the print medium and make two or more drops of ink with different primary colors at the same dot locations ("pixels"), as disclosed in U.S. Pat. No. 4,855,752 which is assigned to the assignee of the present invention.

The printer 100 has several different modes of printing. Each of the different modes is used to produce a different type or quality of an image. For example, one or more "high quality" modes can be specified whereby density of the print dots is increased to enhance the quality of the printed images. In some printers, a "high quality" mode of printing may require the printer 100 to make multiple passes across substantially the same horizontal portion of the page.

For example, in its high quality three pass mode, printer 100 make three sweeps across the page to print a single swath. In each of the three sweeps, the printer would print one of every three consecutive dots so as to allow more time for one dot to dry before the neighboring dot is printed, and thereby preventing the possibility that the ink of the two neighboring dots would combine to produce an unwanted shape or color. Such a three pass printing mode may also be used to reduce banding by dividing the swath into three reduced-height bands, printed in successive but overlapping printing cycles each providing for three passes across an associated reduced-height band.

In known manner, the image to be printed is defined by the "plot file" which specified which pixels are and which pixels are not to be coated with dots of ink. For color images, the color of the ink is also specified in the plot file.

Figure 8:
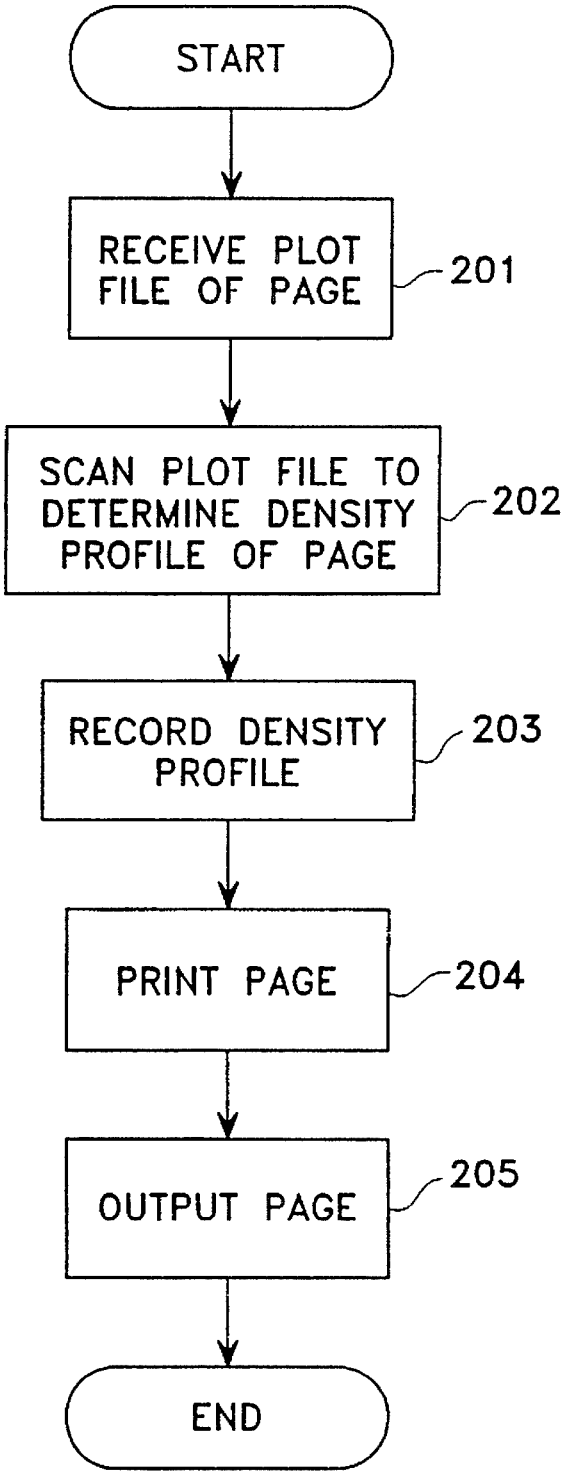
FIG. 8 is a flow chart showing the general steps performed by the printer in printing an image.

FIG. 8 is a flow chart showing the general steps performed by the printer in printing an image.

To print a page, a plot file is first sent to the printer 100 (step 201). As the plot file is being received by the printer 100, it is scanned by the controller 120. The controller 120 scans the plot file to divide it into one or more printed swaths and at the same time produces a density profile for the entire page (step 201).

More particularly, when the controller 120 scans the plot file, it also divides it into a plurality of grids each with a predetermined shape and size, each identified by an x-coordinate and a y-coordinate. For each grid, the controller 120 determines the number of dots that need to be printed with each type of ink.

According to one method, each swath to be printed in a single sweep of the carriage is subdivided into a plurality of rows and each row is subdivided into a plurality of non-overlapping grids; each dot on the page may belong to only one grid. The density of each grid is then determined by counting the number of pixels to be printed in a representative randomly selected sample of the pixels in the grid. A maximum row density is then obtained from the individual grid densities in each row, and a maximum sweep density is then obtained from the individual row densities in the sweep.

Figure 4:
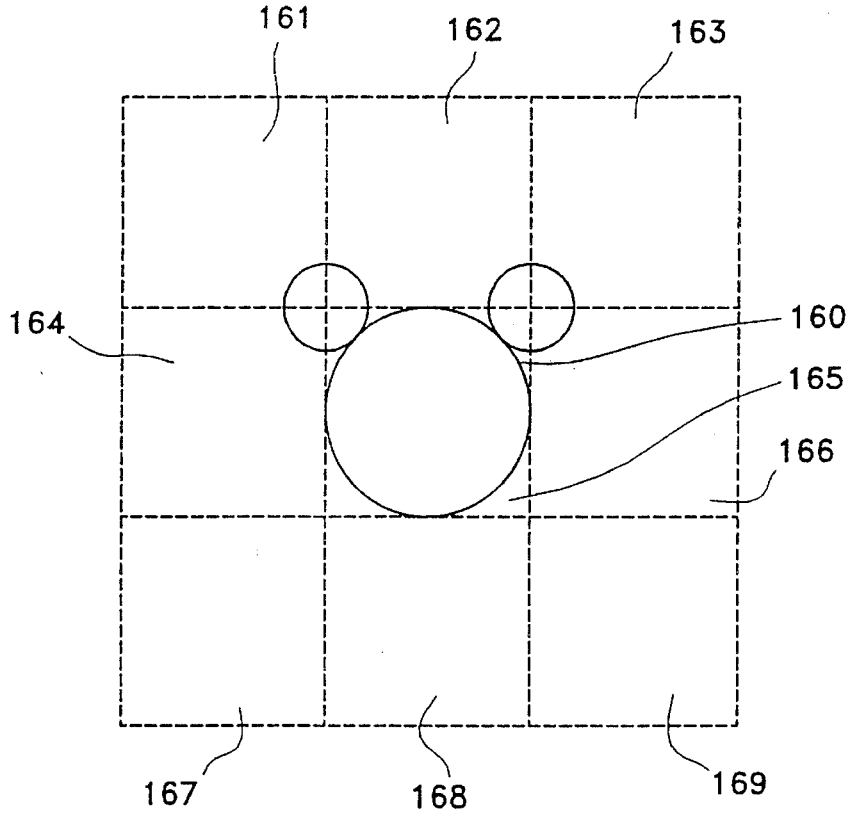
FIG. 4 shows how an image may be scanned by a non-overlap method.
Figure 5:
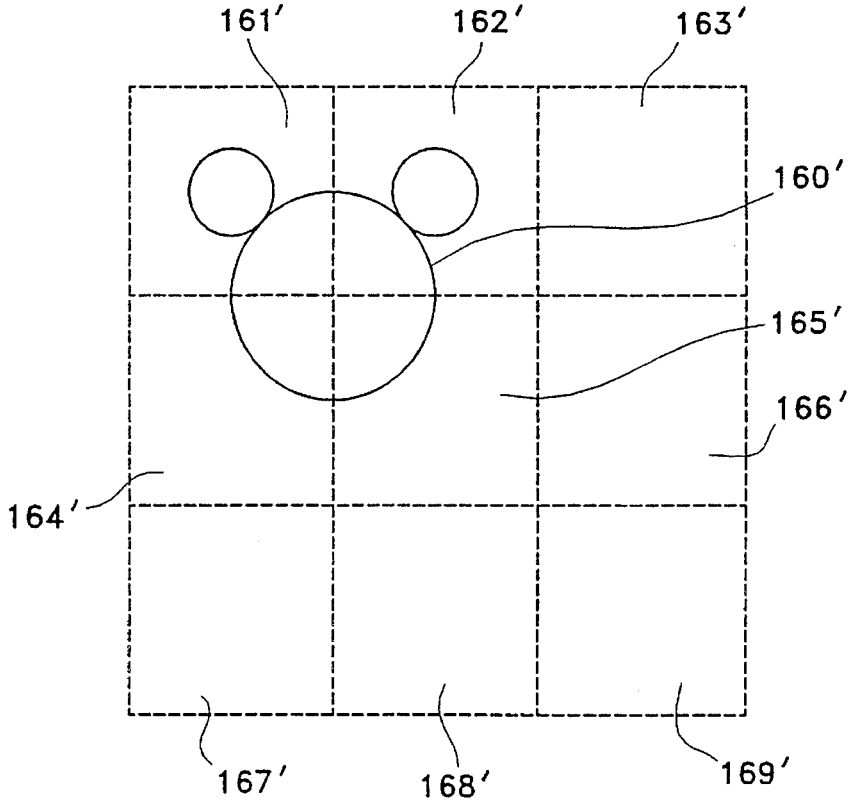
FIG. 5 shows how a difference may result in the method of FIG. 4 if the same image is scanned by the same non-overlap method when the position of the image changes.

Although such non-overlap scanning using only a representative sample is faster, it may, however, produce inaccurate results. To illustrate, assume an image to be printed by the printer has the shape 160 as shown in FIG. 4 and assume that the scanning is performed by square grids 161, 162, . . 169. Depending upon the position of the image 160 with respect to the grids, different density profiles may result. For example, if the image 160 falls by chance in the middle of a grid 165 as shown in FIG. 4 the density profile would show a high density, D1, in grid 165. On the other hand, if same image 160' per chance falls in the intersection of grids 161', 162', 164' and 165' as shown in FIG. 5, then the highest density of the image 160' would be about a fourth of the density D1 obtain from the scanning performed as shown in FIG. 4.

Moreover, accuracy of the local density profile is also a function of the size of the grid. For example, a density profile which is made with a non-overlapping grid size of 150×150 dots will more accurately reflect a dense image having a size of only 300×300 dots than a density profile which is made with a non-overlapping grid size of 300×300 dots. However, if grid size were so small that a single grid could have a density of 100% but the solvent could nevertheless rapidly diffuse into adjacent unprinted areas, such a small grid size would not provide a useful measure of the probability of an image being sufficiently dense to adversely affect print quality.

Figure 6:
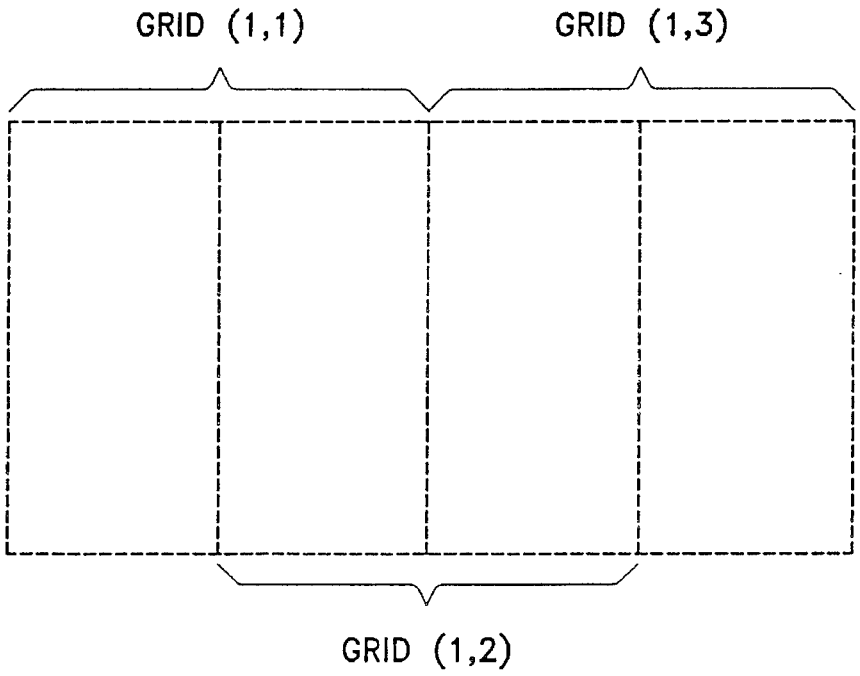
FIG. 6 shows how scanning can be overlapped horizontally to reduce differences caused by positional variations of an image.

However, more accurate measurement of the dot density may be obtained by overlapping the larger grids vertically and/or horizontally, to thereby obtain the advantages of both the larger and the smaller grid sizes. FIG. 6 shows how horizontal overlapping is performed with respect to three exemplary grids G(1,1), G(1,2) and G(1,3). As shown, the left half of grid G(1,2) overlaps right half of grid G(1,1). On the other hand, the right half of grid G(1,2) is overlapped by the left half of grid G(1,3).

Figure 7:
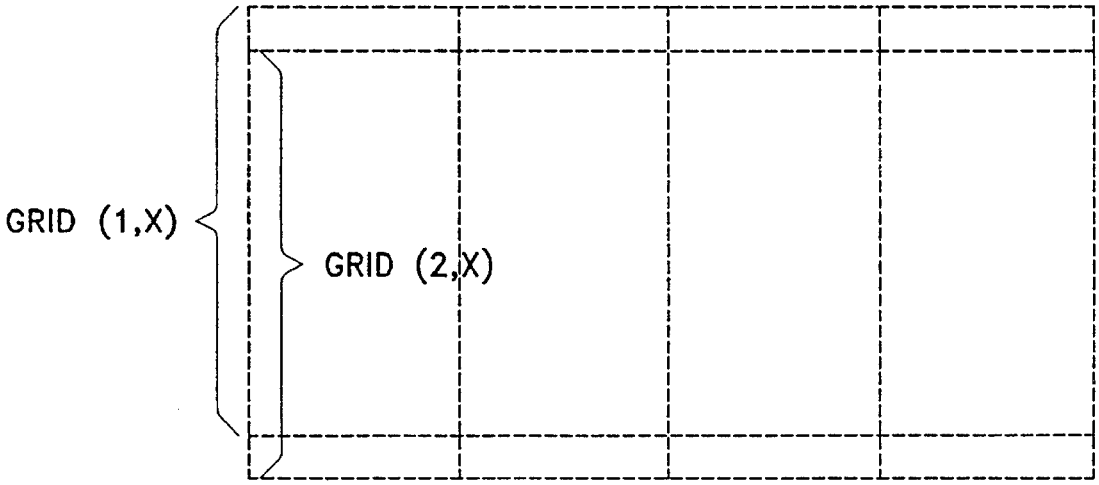
FIG. 7 shows how scanning can be overlapped vertically to reduce differences caused by positional variations of an image.

FIG. 7 shows how both vertical and horizontal overlapping may be combined. A first row of grids G(1 ,x), comprising grids G(1,1 ), G(1,2) and G(1,3) of FIG. 6 and a second row G(2,x) of grids which overlap with the first row G(1,x). For example, the upper 5/6 of grid G(2,1) in the second row overlaps the lower 5/6 of grid G(1,1) of the first row, and the upper 5/6 of grid G(2,2) overlaps the lower 5/6 of grid G(1,2).

Figure 9:
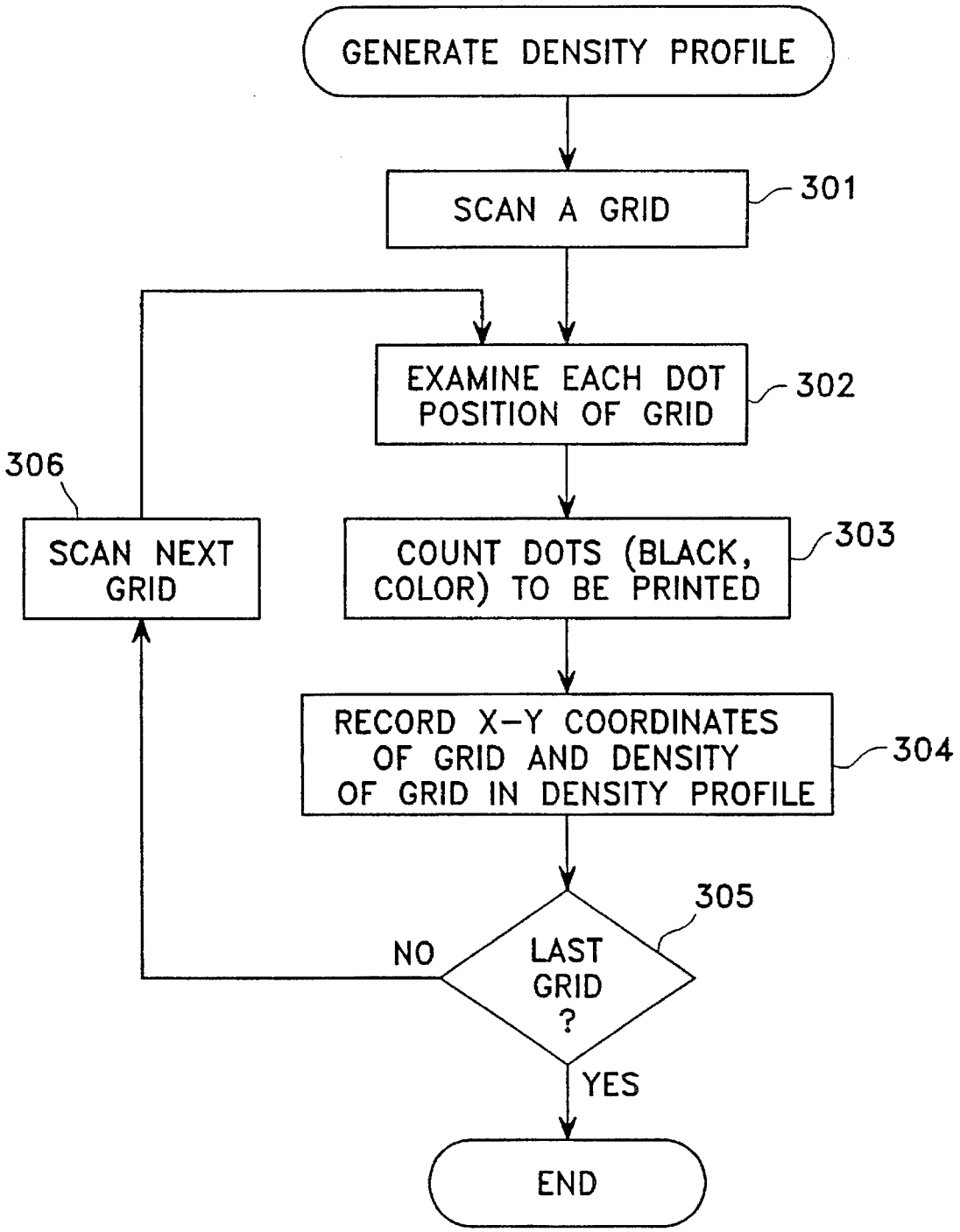
FIG. 9 is a flow chart showing the steps performed by the printer for generating a density profile of an image to be printed.

FIG. 9 is a flow chart illustrating the basic steps required to generate a density profile. The steps are performed by the densitometer procedure when it is executed by the controller 120.

In step 301, a grid of the image to be printed is scanned. In scanning the grid, each dot position of the grid is examined (step 302). Within the grid, the number of dot positions which will be printed with black dot and the number of dot positions which will be printed with colored dots are counted (step 303). Separate counts are made of black and colored dots because they are typically produced by inks having different formulations and concentrations. Because all the grids have the same size, the count can therefore be used directly to represent the density of the grip. After all the dot positions are examined, the count and the coordinates of the grid are stored into the memory 125 (step 304). The controller 120 then examines the plot file to determine whether the current grid is the last grid of the page (step 305). If the current grid is not the last grid, then the process is repeated on the next grid (step 306). Otherwise, the procedure terminates.

Figure 10:
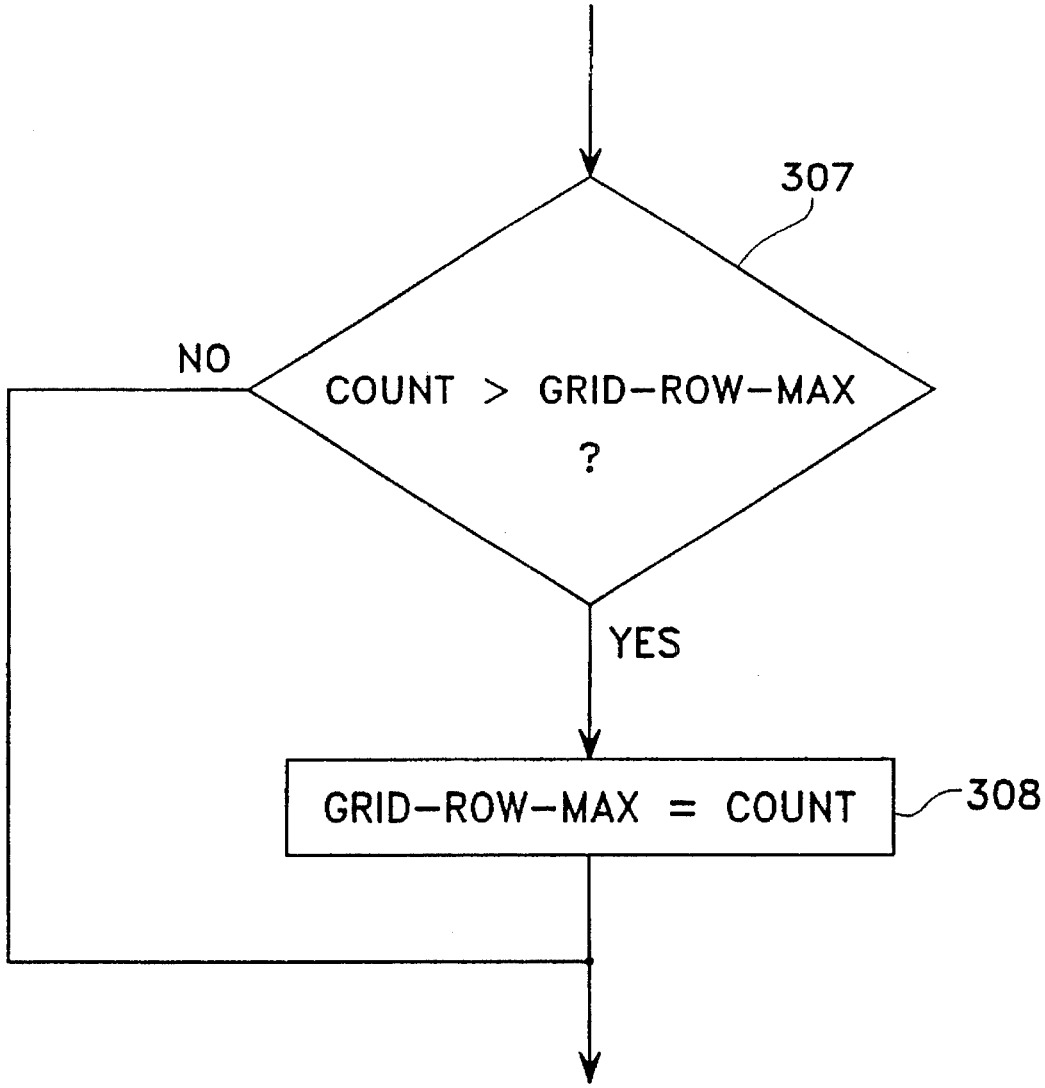
FIG. 10 is a flow chart showing the additional steps performed by the printer to find a grid with the maximum density in each row of grids.

In practice, rather than maintaining a density history for each grid, only a maximum density for one or more rows of grids is stored, with the size of the individual grids preferably being preferably decreased. As a row of grids is being scanned, the grid with the maximum density in the row is located, along with its density value. This is accomplished by providing a variable, GRID-ROW-MAX, and the additional steps shown in FIG. 10 which are performed between steps 303 and 305. In step 307, the count obtained from step 303 is compared with the value stored in GRID-ROW-MAX. If the count of the current grid is greater than GRID-ROW-MAX, its value is stored into GRID-ROW-MAX (step 308); otherwise, step 308 is bypassed. It will be understood that GRID-ROW-MAX is initialized (by setting it to "0") at the beginning of the procedure shown in FIG. 9. If it is necessary to determine a maximum density for an area covering more than one grid row, this can be done by using a similar procedure to determine the maximum of the previously stored GRID-ROW-MAX values for each grid row involved. Alternatively, GRID-ROW-MAX is not re-initialized at the beginning of each row, but is re-initialized only once at the beginning of the area and is used until all the rows in that area have been processed. Similarly, if it is desired to determine a local density based on a grid size larger than that used to process the individual rows, this may be approximated by assuming that the maximum density locations in adjacent rows relate to adjacent portions of the image, and thus may be approximated by averaging the maximum densities of the adjoining rows; in any event, such an assumption would provide a calculated maximum density that is no less than the actual density.

Referring back to FIG. 8, after the plot file is scanned and the required density information has been stored as a function of grid or row location, the page is printed (step 204). In practice, because only one swath is printed at a time, it is preferable to perform the printing operation (step 204) concurrently with the scanning operation (step 202), in which case as soon as all the pixels in one swath have been scanned, that swath can be printed, thereby increasing throughput and reducing the size of the buffer necessary to store the plot file.

Figure 11:
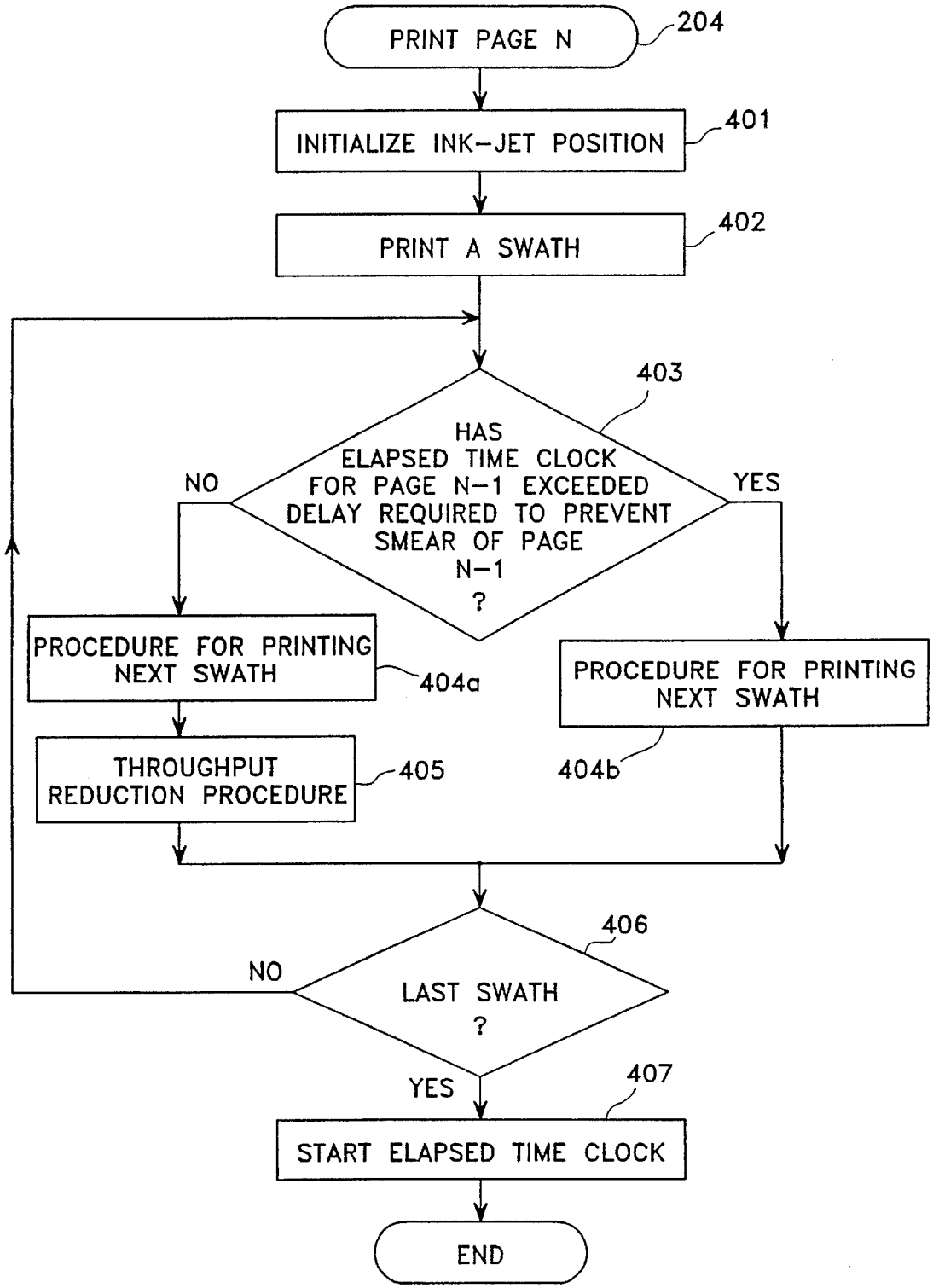
FIG. 11 is a flow chart showing the procedure performed in the printer to print a page.

FIG. 11 is a block diagram showing the procedure performed by the controller 120 for printing a page N among a series of pages.

In step 401 of the procedure, the controller 120 performs an initialization of the printer 100 to print the page N. The initialization includes executing the appropriate driver routines to position the inkier nozzles in a known position relative to a top corner of the page. When initialization is complete, the controller 120 causes the first swath of the page to be printed (step 402).

Before each swath is printed or skipped over in whole or in part by the throughput enhancement logic, the controller 120 checks a page timer to see if the time elapsed since the printing of the last page, page N-1, has exceeded the throughput enhancement delay needed to avoid any possibility of smearing the previous page N-1 when page N is output (step 403). This delay is based upon the maximum density of page N-1.

As a first approximation, there is a linear relationship between the local density of a particular portion of the image and the required drying time before the ink in that portion is sufficiently dry that it will not be smeared when it comes into contact with another sheet. Accordingly, it is necessary to delay any contact of the particular portion of the first sheet with any part of the next sheet by a time:

$$Tdry=Kdry \cdot Den$$

where Tdry is the total drying time required, Kdry is an experimentally derived constant and Den is the density of the selected portion.

Although a separate Tdry could be calculated for each swath of the first page which would be used to start a timer as soon as that swath was printed, the required computations are simplified by determining only a single maximum density for the entire first page, and using that maximum density to calculate a worst case Tdry for that page. Since for equal ink density, the last portion to be printed will be the wettest, the implementation is further simplified by using only one timer and not starting the timer until the entire page has been printed.

Consideration should also be given to the fact that in the preferred embodiment illustrated in FIG. 1, as the next page is being printed, its leading edge (typically the top of the page) is propelled by the paper advance mechanism (starwheel 110 and output roller 111) away from the platen 109 and into the output tray 104 in which the previously printed sheets are stacked, with the last printed sheet on the top of the stack with its printed side facing up. Thus, the leading edge of the page currently being printed is free to curve downward under the influence of gravity in the direction of output tray 104 and first contacts the printed area of the previous sheet at a predetermined distance of about 9½" (about 240 mm) from the top. The leading edge of the next sheet then glides over the upper portion of the previous sheet until the current page has been printed and the two sheets are more or less aligned one on top of the other. Accordingly, the vertical location of the densely inked portion on the first page determines when it will first contacted by the next page.

It will also be appreciated that, in the absence of throughput enhancement strategies such as vertical and horizontal logic seeking, there is a fixed delay between the time page N is output into tray 24 and the time page N+1 will come into contact with page N. As a practical matter, it is advantageous to use that fixed delay to specify process variables such as ink drying time, in order to guarantee a minimum throughput rate for an entire page of graphics having at least some densely inked areas.

Accordingly, the calculation of the required delay can be further simplified by realizing that rather than determine how much delay is required, it is sufficient to inhibit such throughput enhancement under certain degenerate conditions wherein a page having inked portions of higher than normal density is immediately followed by a page having relatively large printed areas.

In an exemplary embodiment, these considerations are reflected in the following equation:

$$0sec<Inhibit=K1+K2*(Den)+K3*(Loc)<Inhibit_{Max}$$

where

Inhibit is the elapsed time during which any throughput enhancement should be inhibited K1 is an empirical offset constant K2 is an empirical density coefficient K3 is an empirical location coefficient and $Inhibit_{Max}$ is predetermined maximum.

In the exemplary embodiment, $Inhibit_{Max}$ is 48 seconds, (Den) ranges from 0 to 1 (1 being solid black) and (Loc) ranges linearly from 1 (at the top of the page) to 4 (at 240 mm from the top); for all modes except high quality three pass mode, K1, K2 and K3 are zero (ie, there is no need to inhibit throughput enhancement). In the case of a high quality three pass mode (which prints a large black image with two drops of ink at every pixel), K1 is −15, K2 is 48 and K3 is 1.

Thus, in the exemplary embodiment, throughput enhancement in high quality three pass mode is inhibited for a maximum of 34 seconds for a 100% dense square at the top of the preceding page, for 33 seconds for the same square at the bottom of the page, or for 37 seconds for the same square at the more critical location 240 mm from the top. If the density of the densest square is only 50%, the corresponding throughput enhancement delays are 11, 10 and 13 seconds, and for a 25% density are 0, 0 and 1 second.

In steps 404*a* and 404*b*, the controller performs a procedure for printing the next swath.

If the time elapsed since the printing of page N-1 has not exceeded the delay required to prevent smearing of page N-1 when page N is output, then a throughput reduction procedure (step 405) is executed. On the other hand, if the elapsed time has exceeded the required delay, then the throughput reduction procedure is not executed.

Referring back to FIG. 11, in step 406, the controller 120 checks whether the last swath of page N has been processed. If not, steps 403–406 are repeated.

If the last swath of page N has already been printed, then the elapsed time clock is restarted (step 407). The elapsed time clock is restarted so that it can be used in step 403 when page N+1 is being printed.

Figure 12:
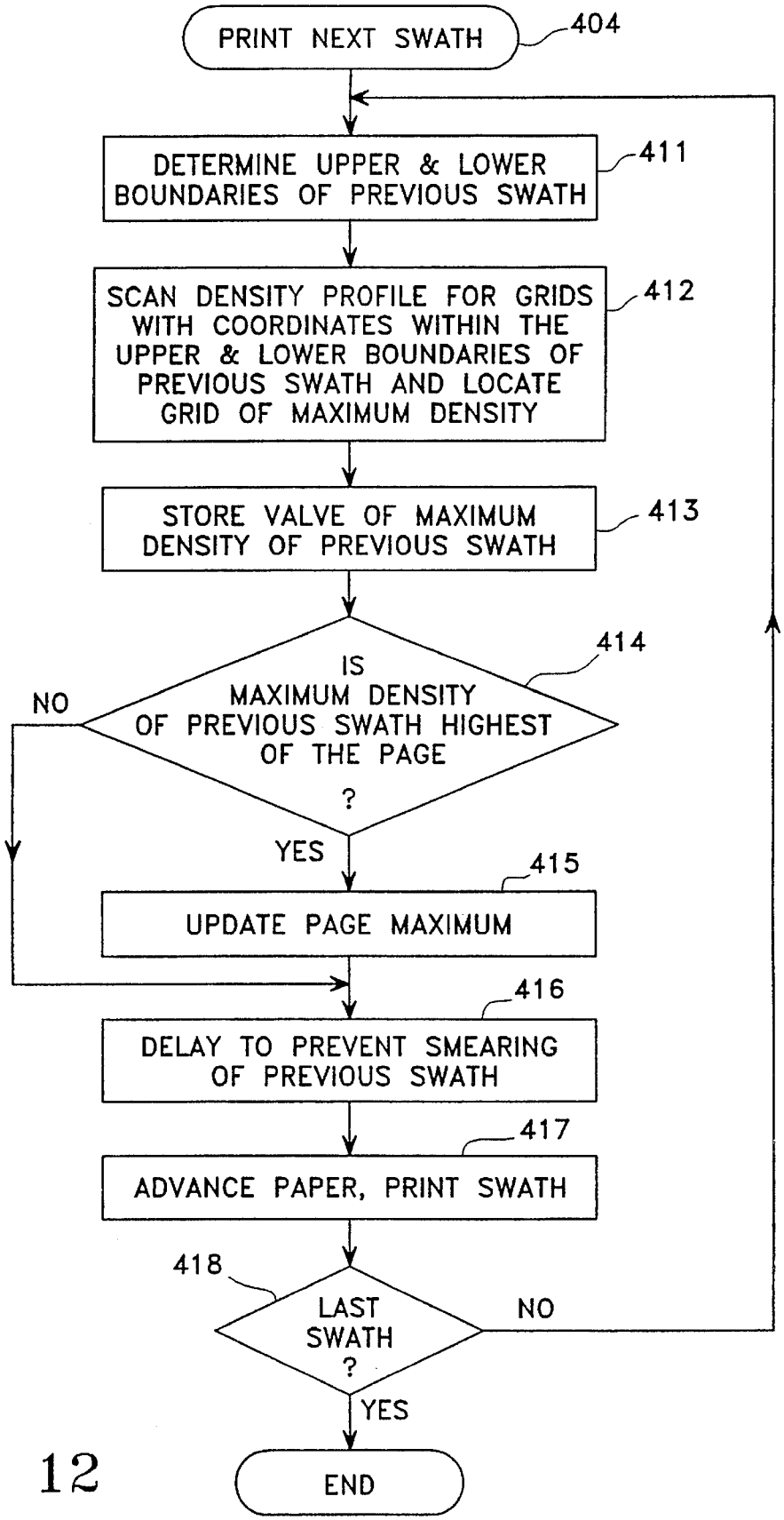
FIG. 12 is a flow chart showing the procedure performed in the printer to print a swath.
Figure 13:
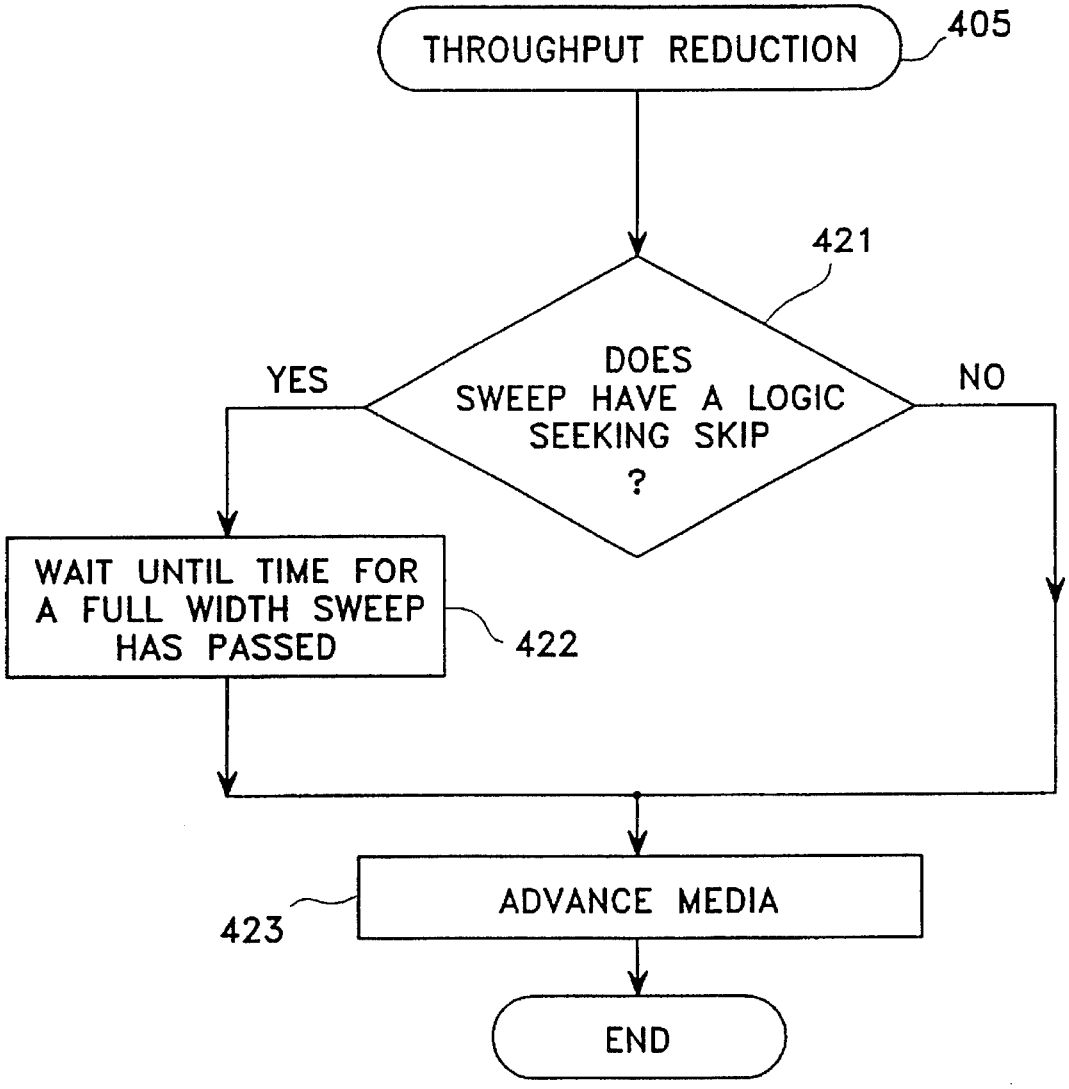
FIG. 13 is a flow chart showing the steps performed in the printer for reducing its throughput to prevent smearing of the previous page.

FIG. 12 is a flow chart showing the procedure which the controller 120 performs to print a swath.

Before printing or skipping over the next swath, the controller 120 first determines the upper and lower boundaries of the previous swath (step 411 ). The upper boundary can be defined as the y-coordinate of the highest row of pixels in the swath and the lower boundary can be defined as the y-coordinate of the lowest row of pixels in the swath.

In step 412, the controller 120 scans the density profile for all the grids (or the density profiles for all the rows, if only GRID-ROW-MAX was stored), whose y-coordinates are within the values of upper and lower boundaries of the previous swath and retrieves the maximum density associated with those grids (or rows), and stores its density in the memory 125 (step 413). To facilitate the concurrent scanning of the plot file and the printing of the individual swaths, a respective location can be reserved in the memory 125 for storing the value of the maximum density of each swath. The controller 120 also checks to see if the maximum density of the previous swath is the highest density of the page (step 414). If so, the highest density of the page is then updated with the maximum density of the sweep (step 415). The value of the highest density of the page is used in step 403 of the procedure shown in FIG. 11 for determining when the current page can be output without smearing the previous page.

The controller 120 then determines whether a delay is required for the previous swath to dry so that it will not be smeared by the upcoming sweep.

The delay for preventing smearing of the previous swath can be determined by several methods.

One such method is to perform a table look-up based upon the maximum density of the swath to find a minimum time delay for which the previous swath should remain over the heated platen 109 before the paper is advanced or the carriage is moved over any portion of the previously printed swath, to thereby prevent any possibility of smearing. In order to speed up and simplify the required computations, separate tables are preferably maintained for different paper sizes and print modes; the table look-up is preferably performed using only the maximum density of the swath as determined in the densitometer procedure and preferably assumes a worst case condition that the maximum density is representative of average density over an area larger than a single grid. The controller 120 performs the table look-up to determine the minimum time required for the swath.

The values of the table can be obtained empirically. Several sets of exemplary values are listed in the following tables:

| density | Minimum Time (seconds) |
|---|---|
| A-size, Plain | |
| >150 | 1.50 |
| >75 | 1.20 |
| >25 | 0.80 |
| >0 | 0.45 |
| A-size, Color Transparency | |
| >150 | 1.35 |
| >75 | 1.10 |
| >25 | 0.80 |
| >0 | 0.45 |
| B-size, Plain, or Color Transparency | |
| >150 | 1.70 |
| >75 | 1.40 |
| >25 | 0.90 |
| >0 | 0.45 |

Figure 14:
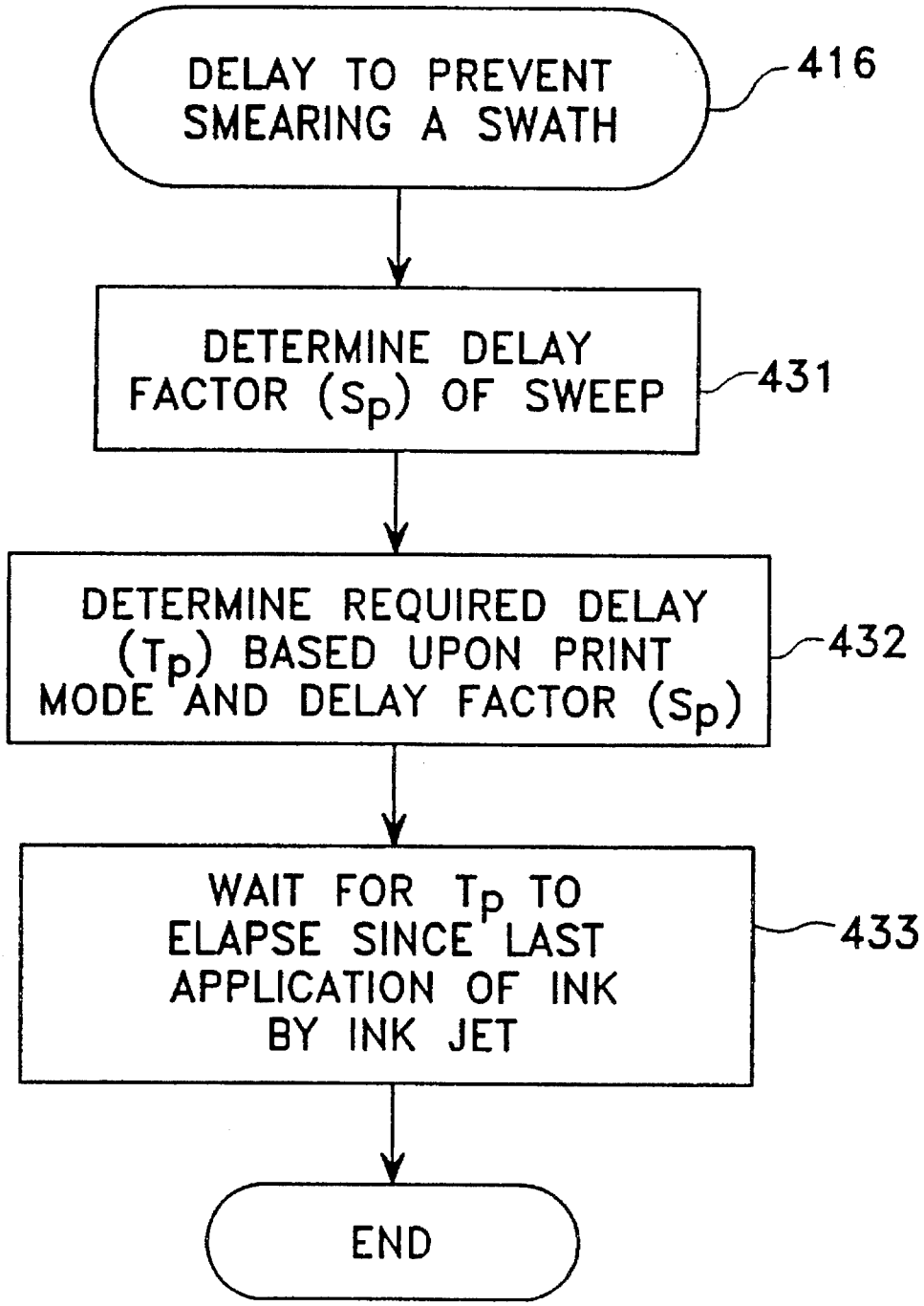
FIG. 14 is a flow chart showing the steps performed by the printer for determining the delay required to prevent smearing of the previous swath.

Another method for determining the delay, which is preferred for its greater accuracy, but which is computationally more complex, is illustrated in the flow chart of FIG. 14. In step 431, the controller 120 determines a delay factor (Sp) used to adjust the nominal advance delay (for each pass, if a multiple pass mode) of the current print mode based upon the swath's maximum density. This delay allows the solvent to evaporate sufficiently to prevent scraping of a previously printed swath while printing of the next swath. The swath density may include a value (Bden) which is the density of single color dots and a value (Cden) which is the density of multi-color dots obtained by the densitometer procedure.

In general, the delay factor (Sp) is determined by the formula:

Sp=f(Mode, Bden, Cden)

where f(Mode, Bden, Cden) is a mode-dependent function of the density (Bden) of black dots and the density (Cden) of color dots on the swath.

In the preferred embodiment, the delay factor Sp is determined by the formula $$100\% \geqq Sc-[K1*Bden+K2*Cden] \geqq Smin$$

where Sc, K1, K2 are empirically established coefficients, with only Sc and Smin dependent on print mode. Exemplary values for K1 and K2 are 2.5 and 0.75 respectively. Exemplary values for Sc and Smin are set forth in the following Table:

TABLE

| Print Mode | Sc | Smin |
|---|---|---|
| Normal | 300 | 75 |
| Performance | 300 | 75 |
| High-quality 1-pass | 200 | 30 |
| High-quality 3-pass | 237 | 50 |

To illustrate the application of the equation, assume that a page is printed in normal mode (i.e., the value of Sc is 300) and that the densest grid has 80% of its pixels printed with black dots. From the above, the preferred delay factor Sp is $$300\%-2.5*80\%=300\%-200\%=100\%$$

Thus, in normal and performance modes, a maximum black density of 80% or less will not cause any reduction of throughput. Similarly, a black density of 90% will cause a maximum reduction of throughput by reducing the nominal advance delay by the minimum delay factor of 75%; for density values between 80% and 90%, the advance delay will vary linearly between 100% and 75% of its nominal value.

For high quality 1 pass mode, the maximum slowdown (50%) is utilized for black densities greater than 68%, which increases linearly to 100% at a density of 40%. For the high quality 3 pass mode, the corresponding figures are 74.8% density (50% slowdown) and 54.8% density (no slowdown).

The controller 120 then uses the delay factor Sp to determine the required advance delay (tp) for printing the swath upon the specified print mode of the swath (step 432). The time tp is determined in the preferred embodiment by dividing a nominal advance time tn by the delay factor Sp. The nominal advance time tn is dependent on the print mode and may be stored in a look-up table; in an exemplary embodiment, it is 0.527 seconds for a high quality three pass mode and 0.512 seconds for all other modes.

The result of the above identified division is then used to set a swatch delay timer. After the required advance delay time has elapsed (step 433), the controller 120 activates the appropriate drivers to advance the print medium in preparation for the next sweep (step 416). When the delay has elapsed, the controller 120 then activates the appropriate drivers to cause the inkjet to make a sweep (step 417). After the sweep is made, the controller 120 checks to see if the sweep just made is the last sweep of the page (step 406). If the sweep is not the last one for the page, steps 411 to 418 are then repeated.

To summarize, in a preferred embodiment, a variable delay for preventing smearing of the swath just printed by contact with the nozzle plate or other parts of the printer mechanism is a function of the density profile of the swath, and a variable delay for preventing smearing of a previous page by contact with a next page is a function of the density profile of the previous page. These related concepts enable the printing of densely-inked images without smearing and without sacrificing throughput and print quality.

It is understood that the above-described embodiment is merely provided to illustrate the principles of the present invention, and that other embodiments may readily be devised using these principles by those skilled in the art without departing from the scope and spirit of the invention.

What is claimed is:

1. A sheet fed inkier printer in which liquid ink is applied to at least a first and a second sheet of print medium in a succession of horizontal swaths, comprising:

a print head having a plurality of vertically displaced print nozzles;

sheet feeding means for advancing each of the sheets vertically past said print head;

carriage means for slewing said print head horizontally across successive said horizontal swaths of each of the sheets at respective vertically displaced portions of said each sheet;

print means for printing a respective image on each of the sheets by selectively applying dots of said ink to the sheet through selected ones of said nozzles as said print head is slewed by said carriage means;

throughput enhancement means for varying an actual throughput rate determined by a sum of (a) a variable intra-sheet printing delay equal to a first elapsed time between an initial positioning of the print head adjacent a top portion of said second sheet before a first horizontal swath has been printed and a final positioning of the print head at a bottom portion of said second sheet after a last horizontal swath has been printed and (b) an inter-sheet feeding delay equal to a second elapsed time between the final positioning of the print head adjacent said first sheet and the initial positioning of the print head adjacent said second sheet;

deneitometer means responsive to respective locations of the dots for determining a location of a densely printed area of said first sheet and the density of said location;

stacking means for stacking said second sheet onto said first sheet as said second sheet is being printed; and anti-smear means responsive to at least the density output by said densitometer means relating to said densely printed area of said first sheet for causing the throughput enhancement means to maintain said variable intra-sheet printing delay during printing of said second sheet above a value where the second sheet will come into contact with said densely printed area of the first sheet before the ink in said densely printed area of the first sheet has dried such that the first sheet is not subject to being smeared by such contact with the second sheet.

2. The printer of claim 1, wherein said densitometer means is responsive to said print means.

3. The printer of claim 2, wherein each of said horizontal swaths is organized as a plurality of pixels, said densitometer means divides each of the sheets into a number of grids each containing a number of said pixels, said print means determines which of the pixels included in each said horizontal swath receive said dots of ink, and said densitometer means counts the number of said dots of ink in the pixels included in each of said grids.

4. The printer of claim 3, wherein each of said grids has substantially fewer pixels than are present in a corresponding area of each of said horizontal swaths.

5. The printer of claim 3, wherein said densitometer means utilizes overlapping said grids, with at least one half of each of said grids overlapping a respective horizontally adjacent grid and at least one half of each of said grids overlapping a respective vertically adjacent grid.

6. The printer of claim 5, wherein at least five sixths of said each grid overlaps said respective vertically adjacent grid.

7. The printer of claim 1, wherein said throughput enhancement means searches for blank portions of each of said horizontal swaths.

8. The printer of claim 7, wherein said throughput enhancement means reduces the size of at least some of said horizontal swaths.

9. The printer of claim 7, wherein said throughput enhancement means searches for horizontal swaths having both printed and blank portions and causes the print head to horizontally traverse at least one of said blank portions at a higher slew rate.

10. The printer of claim 7, wherein said throughput enhancement means searches for unprinted horizontal swaths having only blank portions, and causes the print head to advance vertically over successive such unprinted horizontal swaths.

11. The printer of claim 10, wherein said print head does not horizontally traverse at least one of said successive unprinted horizontal swaths.

12. The printer of claim 7, wherein the anti-smear means determines, from at least the density of said densely printed area of said first sheet, a required delay before the print head is enabled by the throughput enhancement means to either traverse any such blank portions at a higher slew rate, or skip such blank portions altogether.

13. The printer of claim 1, wherein said stacking means causes the top portion of the second sheet to come in contact with an intermediate portion of the first sheet before the print head is positioned at the bottom portion of the second sheet, said densitometer means also outputs said location of the densely printed area of said first sheet, said anti-smear means is also responsive to said location, and said anti-smear means determines a greater value for the variable intra-sheet printing delay during the printing of said second sheet if said densely printed area of said first sheet is at said intermediate portion.

14. In a sheet fed inkjet printer in which liquid ink is applied to a sheet of print medium in a succession of horizontal swaths and including a print head having a plurality of vertically displaced print nozzles, sheet feeding means for advancing said sheet vertically past said print head, carriage means for slewing said print head horizontally across successive said horizontal swaths at respective vertically displaced portions of the sheet, print means for printing an image on said sheet by selectively applying dots of said ink to said sheet through selected ones of said nozzles as said print head is slewed by said carriage means, densitometer means responsive to said print means for determining a location of a densely printed area of said sheet and a density of said location, and stacking means for stacking successive sheets after said sheets have been printed, the improvement comprising:

throughput enhancement means for reducing a time said print head is traversing across blank portions of said sheet to thereby establish a variable throughput rate determined by a sum of (a) an intra-sheet printing time between an initial positioning of the print head adjacent a top portion of the sheet before a first horizontal swath has been printed and a final positioning of the print head at a bottom portion of the sheet after a last horizontal swath has been printed and (b) an inter-sheet feeding delay equal to a second elapsed time between said final positioning. of a preceding sheet and the initial positioning of said sheet; and anti-smear means responsive to at least a density determined by said densitometer means relating to a densely printed area of said preceding sheet for determining a required delay before the print head is enabled by the throughput enhancement means to either traverse blank portions of said sheet at a higher slew rate, or skip such areas altogether, to thereby maintain said variable throughput rate below a value where the next sheet will come into contact with a densely printed area of the preceding sheet in said stacking means before the ink in said densely printed area of the preceding sheet has dried such that the preceding sheet is not subject to being smeared by such contact with said sheet.

15. The improvement of claim 14, wherein each of said horizontal swaths is organized as a plurality of pixels, said densitometer means divides each of the sheets into a number of grids each containing a number of said pixels, said print means determines which of the pixels included in each of said horizontal swaths receive said dots of ink, and said densitometer means counts the number of said dots of ink in the pixels included in each of said grids.

16. The improvement of claim 14, wherein said throughput enhancement means searches for blank portions of each of said horizontal swaths.

17. The improvement of claim 14, wherein said throughput enhancement means searches for horizontal swaths having both printed and blank portions and causes the print head to horizontally traverse at least one of said blank portions at a higher slew rate.

18. The improvement of claim 14, wherein said throughput enhancement means searches for unprinted horizontal swathe having only blank portions, and causes the print head to continuously advance vertically over successive such unprinted horizontal swaths.

19. The improvement of claim 14, wherein said time is reduced by reducing the number of said horizontal swaths that would otherwise be traversed by the print head.

20. The improvement of claim 14, wherein said time is reduced by reducing the horizontal extent of at least some of said horizontal swaths.

21. The improvement of claim 14 wherein said time is reduced by increasing the slew rate of the print head across at least portions of some of said horizontal swaths.

22. The improvement of claim 14, wherein said stacking means causes the top portion of the next sheet to come in contact with an intermediate portion of the preceding sheet before the print head is positioned at the bottom portion of said sheet, said densitometer means also outputs said location of the densely printed area of said preceding sheet, said anti-smear means is also responsive to said location, and said anti-smear means determines a greater value for the variable intra-sheet printing delay during the printing of said sheet if said densely printed area of said preceding sheet is at said intermediate portion.

23. A method for reducing smearing of an image on a first sheet by contact with a second sheet in a sheet fed printer in which liquid ink is applied to each sheet across a succession of horizontal swaths including one or more swaths having one or more printed areas and possibly also including blank lines, comprising the steps:

locating one or more of said printed swaths of said first sheet having at least one densely printed area;

calculating a respective delay interval following the application of said ink to said one or more swaths required for all the ink applied to said densely printed area to dry sufficiently to avoid smearing when contacted by said second sheet, said delay interval being a function of the density of said densely printed area of said first sheet;

searching the swaths included in the second sheet for any of said blank lines, and causing the print head to vertically traverse across said blank lines at an enhanced throughput rate only if a leading edge of the second sheet will not be output in contact with said densely printed area of the first sheet before said delay interval has elapsed.

24. The method of claim 23, wherein said delay interval is also a function of a location of said densely printed area.

25. The method of claim 24, further comprising the steps of locating an intermediate portion of the first sheet where the leading edge of the second sheet initially comes into contact with the first sheet, and decreasing said delay interval if said densely printed area is not at said intermediate portion.

26. The method of claim 25, wherein said delay interval is decreased linearly if said densely printed area is above said intermediate portion, and by a fixed constant if it is below said intermediate portion.

* * * * *